US006588341B1

(12) United States Patent
Hieronymus et al.

(10) Patent No.: US 6,588,341 B1
(45) Date of Patent: Jul. 8, 2003

(54) EDGE FOLDING DEVICE HAVING SELF-LOCKING MECHANISM

(75) Inventors: Jens Hieronymus, Darmstadt (DE); Ralf Wadlinger, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/711,243

(22) Filed: Nov. 9, 2000

(30) Foreign Application Priority Data

Nov. 9, 1999 (DE) ..... 199 53 967

(51) Int. Cl.[7] ..... B41F 27/12; B41F 5/00

(52) U.S. Cl. ..... 101/477; 101/415.1; 101/216; 101/480

(58) Field of Search ..... 101/415.1, 477, 101/378, 479, 480, 216

(56) References Cited

U.S. PATENT DOCUMENTS 5,211,112 A * 5/1993 Tsushima et al. ..... 101/415.1
5,309,835 A * 5/1994 Hartung et al. ..... 101/415.1
5,537,922 A * 7/1996 Becker ..... 101/216
5,562,033 A * 10/1996 Schild et al. ..... 101/216

FOREIGN PATENT DOCUMENTS

DE 28 54 672 C2 9/1979
DE 42 14 207 C1 7/1993
DE 198 01 844 A1 7/1998

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A device for folding over an edge of a dressing or packing drawn on a cylinder of a printing or varnishing machine, including an edge folding element, further includes a linkage for moving the edge folding element towards and away from the cylinder, the linkage being constructed as a self-locking mechanism; and a printing or varnishing machine including the device.

11 Claims, 4 Drawing Sheets

EDGE FOLDING DEVICE HAVING SELF-LOCKING MECHANISM

BACKGROUND OF THE INVENTION

Field of the Invention

The invention relates to a device for folding over the edge of a dressing or packing drawn onto a cylinder of a printing or varnishing machine, including an edge folding element and a mechanism or linkage for adjusting the edge folding element towards and away from the cylinder.

A printing plate is drawn onto a plate cylinder in a number of steps. Initially, the leading edge of the plate is firmly clamped in a clamping device applied or fitted to the cylinder. This is followed by actually mounting the plate, wherein the cylinder rotates and a pressure roller rolls on the plate in a direction towards the trailing edge thereof. In order to be able to clamp the trailing edge firmly in a further clamping device applied or fitted to the cylinder, it is necessary to bend the plate around an edge of a channel or gap formed in the cylinder and, in this regard, to press the trailing edge onto a contact surface of the clamping device.

An edge folding device described in the published German Patent Document DE 42 14 207 C1 can be used for this purpose, for example, an edge folding strip or bar thereof being pushed forward by two pneumatic cylinders into a position provided for folding over the edge of the printing plate. Rockers are hinge-mounted on or articulatingly connected to piston rods of the pneumatic cylinders, free ends of the rockers having rollers which press against the edge folding strip in order to displace the latter from the initial position thereof.

As a rule, printing or varnishing plates are very stiff, so that the trailing edge of the plate projecting beyond the edge of the channel or cylinder gap, because of the inherent elasticity of the trailing plate edge, exerts a force acting upon the edge folding strip which forces the latter away from the cylinder until the trailing edge has been firmly clamped into the clamping device.

With regard to preventing the edge folding strip from being forced away by the trailing edge, and intercepting the action of a force exerted by the trailing edge, the edge folding device described in the German patent document is not constructed very advantageously, because during the firm clamping of the trailing edge, the pneumatic cylinders have to continue to have compressed air applied thereto, in order to counteract the force exerted by the trailing edge.

A further disadvantage of the aforedescribed edge folding device is that it cannot be re-equipped or retrofitted for manual actuation. Assuming that, instead of the pneumatic cylinders, an operator were to actuate the rocker, the operator would have to hold the rocker continuously in a rocker position pivoted towards the cylinder until the trailing edge were fully firmly clamped, which would be very awkward. In addition, the operator holding the rocker firmly would not have both hands free to clamp the trailing edge firmly in the clamping device.

Although, on the one hand, there is a trend towards the increasing automation of functions of printing machines, on the other hand, there is also a high demand for printing or varnishing machines which are simple in terms of construction and therefore cost-effective, with a low degree of automation. In the case of these simply constructed machines, the omission of actuating drives, such as the aforementioned pneumatic cylinders for the edge folding strip, and providing instead the capability of operating the machines manually are desirable.

A device described in the published German Patent Document DE 198 01 844 A1 for inserting an edge of a plate exemplifies further prior art. This device does not have a pivotable edge folding element but a slide for inserting the plate into a clamping device, and is much too complicated for simply constructed machines.

SUMMARY OF THE INVENTION

It is accordingly an object of the invention, therefore, to provide an edge folding device which is particularly suitable for manual actuation.

With the foregoing and other objects in view, there is provided, in accordance with one aspect of the invention, a device for folding over an edge of a dressing or packing drawn on a cylinder of a printing or varnishing machine, including an edge folding element, and comprising a linkage or mechanism for moving the edge folding element towards and away from the cylinder, the linkage being constructed as a self-locking mechanism.

In accordance with another feature of the invention, the linkage is constructed as a four-bar linkage with a coupler.

In accordance with a further feature of the invention, the linkage is constructed in a manner similar to a four swivel-joint chain.

In accordance with an added feature of the invention, the coupler forms an element in the linkage which is shortest in terms of central spacings between swivel joints of the linkage.

In accordance with an additional feature of the invention, the coupler has an articulating knee, which is displaceable into an overstretched position, wherein the linkage acts in a self-locking manner.

In accordance with yet another feature of the invention, the knee is formed by the coupler together with a drive rocker arm of the linkage.

In accordance with yet a further feature of the invention, the drive rocker arm is of double-armed construction, including a first lever arm whereon a handle is disposed, and a second lever arm to which the coupler is linked.

In accordance with yet an added feature of the invention, the linkage includes a driven rocker arm disposed so as to be swivellable about a swivel joint and having thereon a stop for the coupler, the stop serving to block overstretching of the knee beyond the overstretched position.

In accordance with yet an additional feature of the invention, the edge folding element is disposed on a lever arm of the driven rocker arm, and the coupler is linked to the lever arm, between the swivel joint and the edge folding element.

In accordance with still another feature of the invention, the device includes a stop for blocking movement of the linkage, the stop being disposed on an element of the linkage.

In accordance with still a further feature of the invention, the device includes a stop for blocking movement of the linkage, the stop being disposed on an element of the linkage located adjacent to the coupler.

In accordance with still an added feature of the invention, the linkage has a swivel joint for swivelling the edge folding element about the swivel joint and towards and away from the cylinder.

In accordance with a concomitant aspect of the invention, there is provided a printing or varnishing machine having a device for folding over an edge of a dressing or packing drawn on a cylinder of the machine, including an edge folding element, and comprising a linkage for moving the edge folding element towards and away from the cylinder, the linkage being constructed as a self-locking mechanism.

Thus, in the edge folding device according to the invention, the mechanism or linkage for moving the edge folding element is constructed as a self-locking mechanism.

This construction of the mechanism is advantageous with regard to the ability to operate the edge folding device manually, because the operator has both hands free to clamp a trailing edge of the dressing or packing drawn on firmly in a clamping device, after the edge folding element has been displaced towards the cylinder into an edge folding position and, after reaching a specific position of the mechanism, the automatic, positively locking blocking thereof with respect to a force acting on the edge folding element has become effective.

The automatically blocking construction of the mechanism or linkage is also advantageous with regard to the equally possible motor-driven movement of the edge folding element into the edge folding position. For example, the application of compressed air to a pneumatic cylinder acting as an actuating motor for moving the edge folding element can be switched off after the self-locking of the mechanism or linkage in the given position thereof has become effective.

In connection with the invention, "edge folding" is understood to mean bending over a dressing or packing drawn onto the cylinder, in particular where the dressing or packing is bent over in a direction towards a cylinder channel or gap formed in the cylinder and towards a clamping device in the cylinder channel or gap and, in particular, where the position of a bending point of the dressing or packing drawn on is predefined during the folding action by an edge of the cylinder channel or gap, beyond which the drawn-on dressing or packing projects.

In an embodiment which is advantageous with regard to minimizing the number of parts, the self-locking mechanism or linkage is constructed as a coupler mechanism or linkage, which comprises four joints and only four mechanism elements connected to one another by the joints. It is preferable for a frame, a drive lever, a coupler and a driven lever to form the four mechanism elements connected to one another by joints In a further embodiment, which is advantageous with regard to cost-effective production of the joints, each of the four joints is a pivot or swivel joint. Two of the pivots can be arranged as stationary pivots for mounting the levers in the frame, while the two other pivots can serve to connect the coupler to the levers.

In a further embodiment, which is advantageous with regard to constructing the coupler mechanism as a double-armed rocker, the center spacing between the two pivots serving to attach the coupler to the two levers is shorter than the other three center spacings. They are the center spacing between those pivots or swivel joints which serve to attach the drive lever to the frame and to the coupler, the center spacing between those pivots or swivel joints which serve to attach the driven lever to the coupler and to the frame, and the center spacing between those stationary pivots or swivel joints which serve to attach the levers to the frame. The frame is preferably the longest element in the coupler mechanism, the center spacing of the stationary pivots serving to attach the levers to the frame being greater than that of the other three aforementioned center spacings.

In a further embodiment, which is advantageous with regard to single-handed operation, a pivot and two elements of the coupler mechanism or linkage that are connected to one another by this pivot form a jointed knee which, in an angular position of the two mechanism elements relative to one another which deviates from a straight line, together with a stop which one of the elements of the mechanism strikes, effects the self-locking of the mechanism.

In a kinematically advantageous further embodiment, the coupler of the coupler mechanism or linkage is the one element of the mechanism or linkage of the knee, and the drive lever which serves to introduce force for displacing the mechanism or linkage is the other element of the mechanism or linkage of the knee.

In a further embodiment, which is advantageous with regard to simple operability of the device, the drive lever is constructed as a rocker which, at one end thereof is connected to the coupler via the pivot or swivel joint, and an operating element is arranged at the free other end thereof.

In a further embodiment, which is advantageous with regard to secure self-locking of the mechanism or linkage, the driven lever is provided with a stop, which the coupler strikes in the overstretched position and which, together with the knee effects the self-locking of the mechanism or linkage.

In a further embodiment, which is advantageous with regard to the ability of the edge folding element to pivot or swivel about a pivoting or swivel axis which is offset relative to a pressure roller, one end of the driven lever is connected to the coupler via a pivot or swivel joint and carries the edge folding element at the free other end thereof. It is therefore possible for separate mountings to be provided for the pressure roller serving to roll the dressing or packing drawn onto the cylinder, and the edge folding element serving to bend the dressing or packing drawn on after it has been rolled on.

The edge folding device according to the invention is preferably assigned to the plate cylinder of a rotary printing machine in order to assist the firm clamping of a printing or varnishing plate. The rotary printing machine may comprise a number of offset printing units and a varnishing unit, constituent parts of which are the plate cylinder and the edge folding device.

Other features which are considered as characteristic for the invention are set forth in the appended claims.

Although the invention is illustrated and described herein as embodied in an edge folding device, it is nevertheless not intended to be limited to the details shown, since various. modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
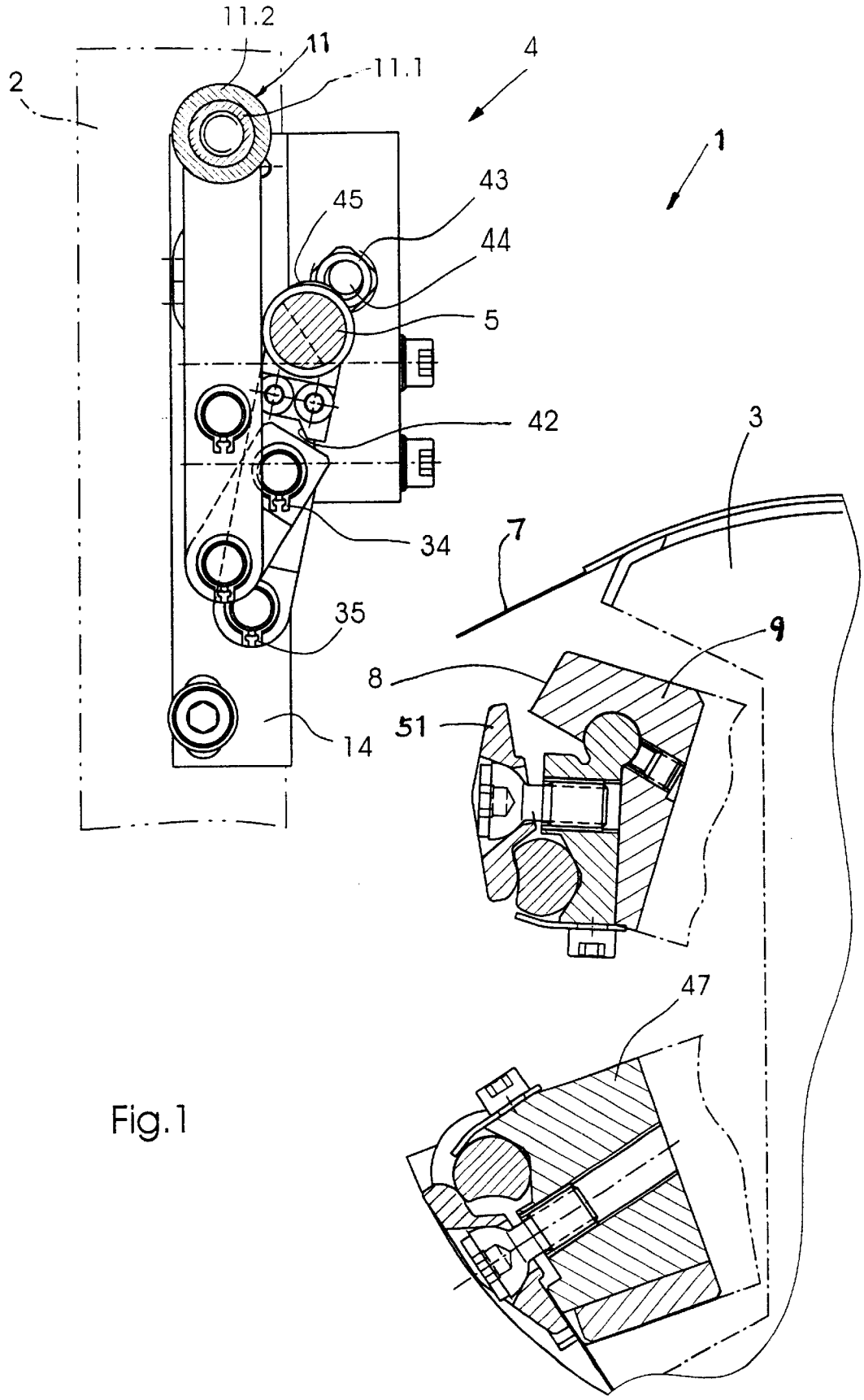
FIG. 1 is a fragmentary side elevational view, partly in section, of a cylinder with a dressing or packing drawn and resting thereon, and an edge folding device having an edge folding element which is withdrawn from the cylinder into a passive position.
Figure 2:
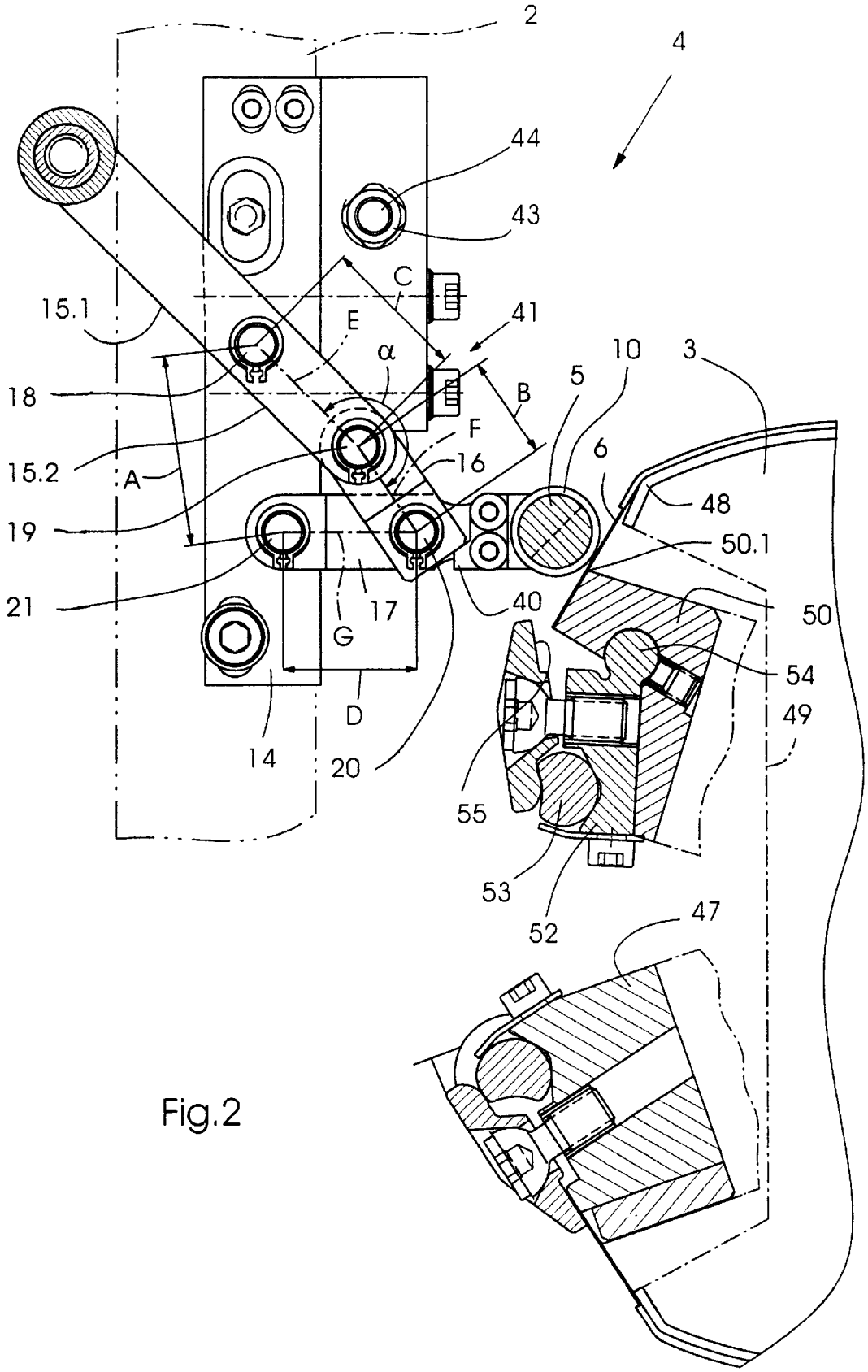
FIG. 2 is a view like that of FIG. 1 showing the edge folding device with an edge folding element displaced towards the cylinder into an edge folding position, and an opened clamping device belonging to the cylinder.

Referring now to the drawings, it is noted that FIGS. 1 to 4 illustrate part of a rotary printing machine 1. The machine 1 includes a number of offset printing units, which are otherwise not specifically shown, and a varnishing unit 2 which includes a plate cylinder 3 and an edge folding device 4. The device 4 has an edge folding element 5 for placing a trailing edge 6 of a dressing or packing 7 drawn onto the cylinder accurately and carefully onto a supporting surface 8 of a clamping device 9 for holding the edge 6. The dressing or packing 7 that is drawn on the cylinder is a plate used for varnishing or printing a sheet-like printing material in the unit 2 and, for example, is a flexographic printing plate. The device 4 is also helpful in the case of the possible firm clamping of a rubber blanket, instead of the drawn-on dressing or packing 7, in the clamping device 9.

The edge folding element 5 which is axially parallel to the cylinder 3 is constructed as a rod with a circular profile, onto which, at regular intervals, soft and elastic rings 10 formed, for example, of rubber, are slid. The rings 10, during contact of the edge folding element 5 with the drawn-on dressing or packing 7, serve to protect the latter against damage, and are seated in annular grooves formed in the edge folding element 5 and secured against slipping in the axial direction thereof. A handle 11 which is approximately as long as the edge folding element 5 and is aligned axially parallel to the latter, is formed of a rod 11.1 of circular profile and a sleeve 11.2 slid onto the rod 11.1. The rod 11.1 is formed of steel and therefore provides the edge folding element 5 with sufficient stability. The sleeve 11.2 is formed of a material that is easy to grip and handle. Both the edge folding element 5 and the handle 11 are fixed at both ends thereof to flat linkages 12 and 13.

Because of the mutually mirror-symmetrical construction and synchronous movement of the linkages 12 and 13, the following detailed description of the linkage 12 is transferrable to the linkage 13, and the latter does not then have to be described specifically.

The linkage 12 is constructed as a four-bar linkage or mechanism, which includes a machine frame 14, a driving rocker arm 15, a coupler 16, a driven rocker arm 17 and four swivel joints 18 to 21 with mutually parallel central axes. The linkage elements 15 to 17 are rods with a square cross section. The swivel joint 21 serves to connect the rocker arm 17 articulatingly to the frame 14, so that the edge folding element 5 is pivotable towards and away from the cylinder 3 about the stationary joint 21. Through the intermediary of the joint 18, the rocker arm 15 is articulatingly connected to the frame 14 so that the rocker arm 15 is pivotable about the stationary joint 18 by the handle 11 in order to move the edge folding element 5.

The joints 18 and 21 are formed of respective joint pins 22 and 23, which are screwed into the frame 14 and are provided with flats 24 and 25 for the attachment of a wrench serving to screw in the pins 22 and 23. In order to secure the pins 22 and 23 against rotation in the frame 14, the screw joints 26 and 27 of the pins 22 and 23 are secured with a thread-lock adhesive. The joint 19 is formed of a joint or articulating pin 28, which is secured against rotation in the coupler 16 by a bonded screw joint 29, and the joint 20 is formed of a joint or articulating pin 30 which is secured against rotation in the rocker arm 17 by a bonded screw joint 31. The coupler 16, which is rotatable about the pins 28 and 30, is seated on tapered extensions of the pins 28 and 30. Securing rings 32 to 35 serve to secure the linkages 15 to 17 axially against slipping on the pins 22, 23, 28 and 30.

The pin 22 is approximately twice as long as each of the pins 23, 28 and 30, and is longer than the thickness of the coupler 16 and the rocker arm 17, taken together, in a direction axially parallel to the pin 22. The dimensioning of the pin 22 permits the mounting of the rocker arm 17 between the frame 14 and the coupler 16, and the mounting of the coupler 16 between the rocker arms 15 and 17.

At one end thereof, the rocker arm 17 is provided with a rectangular transverse groove 36, into which the rocker arm 17 is inserted, so that side surfaces of the rocker arm 17 rest, with an accurate form lock, on mutually opposite flanks 37 and 38 of the groove 36, by which the edge folding element 5 is secured against rotation about the central axis thereof relative to the rocker arm 17, and a further side surface of the rocker arm 17 rests on the base of the groove 36, by which the edge folding element 5 is secured against movement in the axial direction. With regard to the foregoing, it is noted that a formlocking connection is one which connects two elements together due to the shape of the elements themselves, as opposed to a forcelocking connection, which locks the elements together by force external to the elements.

The handle 11 is fixed at one end of the rocker arm 15 by a screw 39 screwed into the rod 11.1 in the longitudinal direction of the latter. Strictly speaking, the handle 11 is arranged at the end of a first lever arm 15.1 of the rocker arm 15, the joint 19 being located at the end of a second lever arm 15.2 of the rocker arm 15 which is shorter than the first arm 15.1. With reference to the joint 21, the rocker arm 17 is constructed with one arm, the joint 21 being arranged at one end and the edge folding element 5 at the other end of the rocker arm 17, and the joint 20 being arranged approximately in the middle of the rocker arm 17.

A center spacing A of the joints 18 and 21 from one another is greater than center spacings B, C and D. The center spacing B between the joints 19 and 20 is less than the center spacing C between the joints 18 and 19, and less than a center spacing D between the joints 20 and 21. The sum of the center spacings B and C is greater than the center spacing A.

Arranged and screwed on the rocker arm 17, between the joint 20 and the edge folding element 5, is a stop 40, which is located on the side of the rocker arm 17 directed away from the frame 14. The stop 40 projects into the pivoting path of the coupler 16, so that the pivoting movement of the latter about the joint 20 is blocked by the stop 40 when a center line E connecting the joints 18 and 19 and a center line F connecting the joints 19 and 20 deviate slightly from rectilinear alignment with one another.

The position of the rocker arm 15 and of the coupler 16 associated therewith, in an over-obtuse angle $\alpha > 180°$ to one another, is referred to as an overstretched position of a knee 41, which is formed of the rocker arm 15, the coupler 16 and the joint 19. The designation "overstretched position" is relevant here because, in the course of a movement relative to one another of the rocker arm 15 and the coupler 16 about the joint 19, the connecting center line F first bends away from the connecting center line E in a direction towards the joint 21 and, after passing through a stretched position ($\alpha$=180°) of the knee 41, with the connecting center lines E and F aligned, bends away from the connecting center line E in the other direction towards the joint 21, the angle $\alpha$ between the connecting center lines E and F being $\alpha$<180° in the last-mentioned position.

When the knee 41 has been moved into the overstretched position and the coupler 16 presses against a stop face 42 on the stop 40, an imaginary extension of the connecting center line E extends beyond the joint 19 through the face 42, and the latter extends at least approximately perpendicularly to the connecting center line F. To provide the aforementioned relative positions in the overstretched position of the knee 41, the face 42 is arranged at an oblique angle to a center line G connecting the joints 20 and 21.

Arranged on the frame 14 is a securing device for fixing the linkage 12 in a passive position (note FIG. 1), with the edge folding element 5 withdrawn from the cylinder 3. The securing device is constructed as a catch or latch, which includes a spring bushing 43 screwed into the frame 14, and a sprung latching or drop-in pin 44 which is inserted into the bushing 43 and has a part thereof protruding from the frame 14 and the bushing 43, the part being rounded in the form of a droplet. When a convexly rounded face 45 of the linkage 12 strikes the pin 44, the latter is forced out of the position thereof, which is parallel to the edge folding element 5 and coaxially aligned with the bushing 43, into a skewed position. The face 45 is formed by the end of the rocker arm 17, into the pivoting path of which the pin 44 projects.

Due to the action of a spring in the bushing 43, the pin 44 is reset into the coaxial starting position thereof, the instant that the pin 44, as the face 45 pivots past the pin 44, snaps in behind a bump on the face 45 which projects to the greatest extent in the direction of the pin 44, and blocks any pivoting movement of the rocker arm 17 and, therefore, of the edge folding element 5, in a pivoting direction towards the cylinder 3. Further pivoting of the rocker arm 17 and of the edge folding element 5 in the other pivoting direction, away from the cylinder 3, is blocked by a face 46 formed on the rocker arm 15, the edge folding element 5 resting on the face 46.

In order to pivot the edge folding element 5 out of the passive position thereof and towards the cylinder 3, as the linkage 12 is moved, it is necessary to overcome the restoring force of the pin 44, the latter, after passing the bump on the face 45, returning quickly into the initial position thereof perpendicular to the frame 14.

The function of the edge folding device 4 is as follows:

After the operator has clamped a leading edge of the drawn-on dressing or packing 7 in a front clamping device 47 in the cylinder 3, an otherwise non-illustrated pressure roller is placed against the drawn-on dressing or packing 7, and the cylinder 3, driven by an electric motor of the machine 1, is rotated slowly forward together with the drawn-on dressing or packing 7 from the front end thereof, so that the pressure roller rolls on the dressing or packing 7, in a direction towards the rear end thereof and, as a result, smoothes the drawn-on dressing or packing 7 onto a circumferential surface of the cylinder 3. When the pressure roller is a short distance in front of a rear edge 48 of a cylinder gap or channel 49 formed in the cylinder 3, this rotation is halted, so that the cylinder 3 is located precisely in a rotary-angle position defined for the edge folding action. The trailing edge 6 then projects beyond the edge 48 of the cylinder gap 49 and virtually tangentially away from the cylinder 3, as shown in FIG. 1.

In order to clamp the trailing edge 6 in the rear clamping device 9, it is necessary to place the trailing edge 6 onto the surface 8 of a clamping support 50 belonging to the clamping device 9. The operator therefore pulls the handle 11 so that it is pivoted in a counterclockwise direction about the joint 18 from the position shown in FIG. 1 into the position shown in FIG. 2. With the force exerted by the operator on the handle 11, the linkage 12 enables the edge folding element 5 to move towards the cylinder 3, driven by the linkage 12, as a result of which the drawn-on dressing or packing 7 is bent around the edge 48 of the cylinder gap 49 by the edge folding element 5, i.e., the edge of the dressing or packing 7 is folded over, and the trailing edge 6 is pressed in the direction of the surface 8. When the operator pivots the handle 11 in order to move the edge folding element 5 from the passive position thereof (note FIG. 1) into the edge folding position thereof (note FIGS. 2 and 3), the limiting force of the latching device, i.e., the spring bushing 43, the latching pin 44 and the face 45, is overcome, as described hereinbefore.

The edge folding element 5 located in the edge folding position presses on the drawn-on dressing or packing 7 in the region between the edge 48 of the cylinder gap 49 and a supporting edge 50.1 of the support 50, as a result of which the dressing or packing 7 is pressed onto the surface 8 approximately in the position parallel to the latter. In the process, the edge folding element 5 presses closer on the supporting edge 50.1 than the edge 48 of the cylinder gap 49 presses on the dressing or packing 7, due to which a maximum bending moment results at the bending point of the dressing or packing 7 in the region of the edge 48 of the cylinder gap 49.

If the operator releases the handle 11 in this situation, the linkage 12 advantageously maintains the position assumed, although a spring force from the comparatively stiff drawn-on dressing or packing 7 attempts to force the edge folding element 5 out of the edge-folding position thereof. This is because the trailing edge 6 attempts to spring back in the direction towards the starting position thereof projecting tangentially from the cylinder 3. Because of this attempt,.the trailing edge 6 presses comparatively forcefully on the edge folding element 5 and therefore produces a torque which attempts to pivot the edge folding element 5 and the rocker arm 17 about the joint 21 in the counterclockwise direction, as viewed in FIG. 2.

This torque is absorbed by the linkage 12, however, in that the stop face 42 is pressed more firmly against the coupler 16, as a result of which, in turn, the overstretched position of the knee 41 is secured. The linkage 12, therefore, blocks a movement of the edge folding element 5 out of the edge-folding position and away from the cylinder 3 when a force is exerted on the edge folding element 5 by the drawn-on dressing or packing 7. Due to the self-locking of the linkage 12, the single-handed operation thereof is possible, and the operator, after displacing the edge folding element 5 into the edge-folding position, does not have to perform any additional locking actions or the like in order to secure the position assumed by the linkage 12.

The tight clamping of the dressing or packing 7 between the support 50 and a clamping jaw 51, which is movable relative to the latter, is performed in two steps.

In a first step, a carrier or beam 52, together with an eccentric shaft 53 mounted in the carrier 52, and the jaw 51 mounted in the carrier 52 are pivoted about a pivot 54, which belongs to the clamping device 9 and has an axis of rotation axially parallel to the cylinder 3, resulting in a clamping face 55 of the jaw 51 overlapping the surface 8 and the drawn-on dressing or packing 7 resting on the latter.

In the subsequent second step, the shaft 53, which is provided with a flattened cross-sectional shape and rests in a prism belonging to the carrier 52, is rotated by the operator about the central axis thereof, due to which, a lever arm belonging to the jaw 51 and resting with a convexity thereof on the shaft 53, is pressed away by the prism, and the jaw 51 is therefore tilted about a further joint, which is formed by the head of a screw in the carrier 52. Due to the tilting of the jaw 51, the other lever arm of the jaw 51, provided with the clamping face 55, is moved in a direction towards the support 50, so that the drawn-on dressing or packing 7 is clamped firmly between the clamping face 55 and the supporting surface 8.

The pressure roller and the edge folding element 5 can then be removed from the drawn-on dressing or packing 7.

Figure 3:
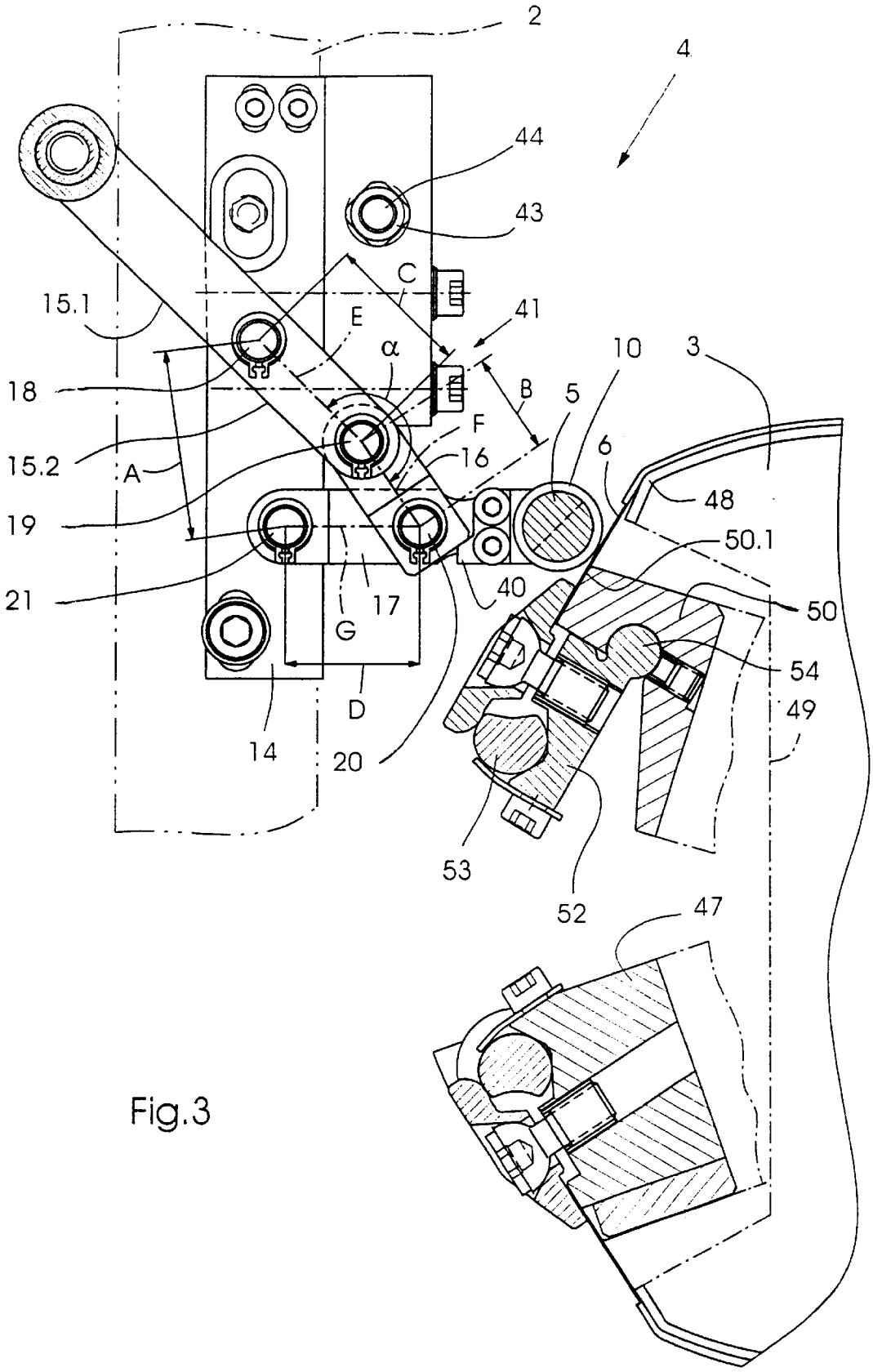
FIG. 3 is another view like those of FIGS. 1 and 2 showing the edge folding device and the clamping device which, in order to firmly clamp the dressing or packing drawn onto the cylinder, is closed, as opposed to the operating phase illustrated in FIG. 2.
Figure 4:
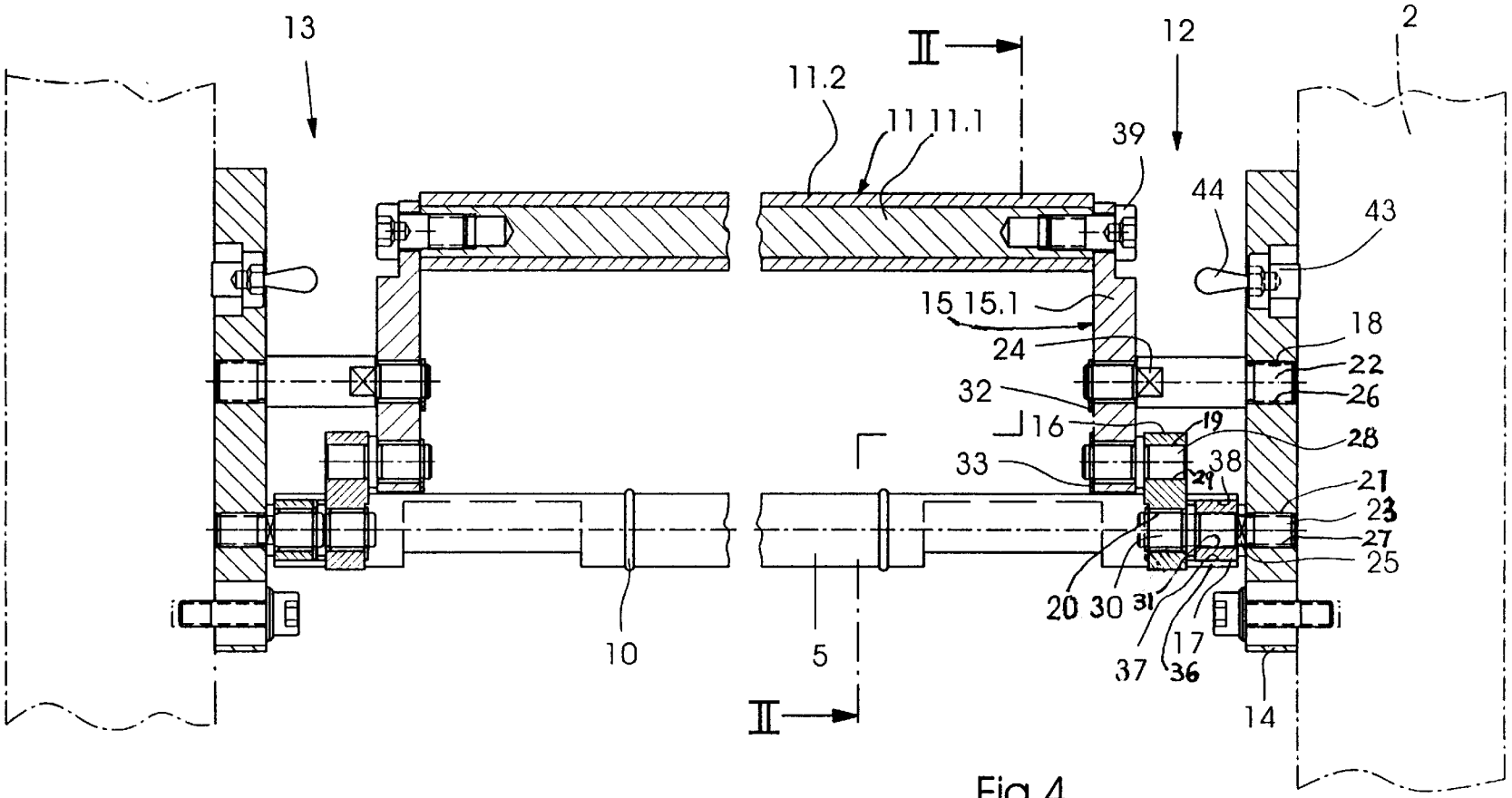
FIG. 4 is a cross-sectional view of the edge folding device wherein the sectional view of FIG. 2 is taken along the line II—II in the direction of the arrows, the cylinder and the dressing or packing drawn thereon having been omitted in the interest of clarity.

In order to reset the edge folding element 5 away from the drawn-on dressing or packing 7 into the passive position of the element 7, the operator has to move the handle 11 and,. therefore, the rocker arm 15, in a clockwise direction about the joint 18, as viewed in FIG. 3. During this pivoting movement, the self-locking position of the linkage 12 is cancelled, as a result of the coupler 16 being lifted off the stop 40 and the knee 41 being rotated out of the blocked overstretched position thereof, beyond the stretched position of the knee 41, into the angular position shown in FIG. 1. When the position of the linkage 12, which is shown in FIG. 1, is reached, the position is secured by the snapping in of the latching device, i.e., the spring bushing 43, the latching pin 44 and the face 45.

The clamping devices 9 and 47 are then moved by a pivoting action, so that the edges of the drawn-on dressing or packing 7, held firmly in the clamping devices 9 and 47, are drawn towards one another and, as a result, the drawn-on dressing or packing 7 is stretched tautly on the cylinder 3.

Finally, it should be noted that the function of the operator can be replaced by an actuating drive which pivots the rocker arm 15 and which, for example, can be constructed as a pneumatic reciprocating piston cylinder and can be attached to the rocker arm 15.

We claim:

1. A device for folding over an edge of a dressing or packing drawn on a cylinder of a printing or varnishing machine, comprising:

an edge folding element; and a mechanism for moving said edge folding element towards and away from the cylinder, said mechanism being constructed as a self-locking mechanism, said self-locking mechanism constructed as a coupler mechanism, said coupler mechanism being constructed as a four-bar chain with a coupler, a drive rocker arm, and four swivel-joints;

said mechanism, after reaching a specific position, automatically and positively locking, blocking against a force acting on said edge folding element.

2. The device according to claim 1, wherein said self-locking mechanism has a stop for blocking movement of said self-locking mechanism, said stop being disposed on said self-locking mechanism.

3. The device according to claim 2, wherein said stop is disposed on said coupler mechanism and located adjacent said coupler.

4. The device according to claim 1, wherein one of said swivel joints function to swivel said edge folding element about said swivel joint and towards and away from the cylinder.

5. The device according to claim 1, wherein said coupler mechanism has an articulating knee displaceable into an over-dead-center position of said knee, and said coupler mechanism acts in a self-locking manner.

6. The device according to claim 5, wherein said knee is formed by said coupler together with said drive rocker arm of said coupler mechanism.

7. The device according to claim 6, wherein said drive rocker arm is of double-armed construction, including a first lever arm whereon a handle is disposed, and a second lever arm to which said coupler is linked.

8. The device according to claim 5, wherein said coupler mechanism includes a driven rocker arm disposed so as to be swivellable about one of said swivel joints and having thereon a stop for said coupler, said stop serving to block said knee from moving beyond said over-dead-center position.

9. The device according to claim 8, wherein said edge folding element is disposed on a lever arm of said driven rocker arm, and said coupler is linked to said lever arm, between said one of said swivel joints and said edge folding element.

10. The device according to claim 1, wherein said coupler is the shortest element in said coupler mechanism in terms of center-to-center spacings between said swivel joints of said coupler mechanism.

11. A printing or varnishing machine having a device for folding over an edge of a dressing or packing drawn on a cylinder of the machine, comprising:

an edge folding element; and a mechanism for moving said edge folding element towards and away from the cylinder, said mechanism being constructed as a self-locking mechanism, said self-locking mechanism constructed as a coupler mechanism, said coupler mechanism being constructed as a four-bar chain with a coupler, a drive rocker arm, and four swivel-joints;

said mechanism, after reaching a specific position, automatically and positively locking, blocking against a force acting on said edge folding element.

* * * * *